US006437226B2

(12) United States Patent
Oudshoorn et al.

(10) Patent No.: US 6,437,226 B2
(45) Date of Patent: Aug. 20, 2002

(54) METHOD AND SYSTEM FOR AUTOMATICALLY TUNING A STRINGED INSTRUMENT

(75) Inventors: Mark Oudshoorn, Bradenton; Jeff Moler, Sarasota; R. Glenn Akhavein, Bradenton, all of FL (US)

(73) Assignee: Viking Technologies, Inc., Sarasota, FL (US)

( * ) Notice: Subject to any disclaimer, the term of this patent is extended or adjusted under 35 U.S.C. 154(b) by 0 days.

(21) Appl. No.: 09/801,347

(22) Filed: Mar. 7, 2001

Related U.S. Application Data

(60) Provisional application No. 60/187,597, filed on Mar. 7, 2000.

(51) Int. Cl.[7] ..... G10G 7/02
(52) U.S. Cl. ..... 84/454; 84/455
(58) Field of Search ..... 84/600–603, 615–618, 84/626, 653–656, 662, 681, 453–455

(56) References Cited

U.S. PATENT DOCUMENTS

| | | | | |
|---|---|---|---|---|
| 3,144,802 | A | 8/1964 | Faber | |
| 3,614,486 | A | 10/1971 | Smiley | 310/8.2 |
| 3,666,975 | A | 5/1972 | Balamuth | 310/8.2 |
| 3,902,084 | A | 8/1975 | May, Jr. | 310/8.1 |
| 3,902,085 | A | 8/1975 | Bizzigotti | 310/8.3 |
| 4,018,124 | A | 4/1977 | Rosado | |
| 4,044,239 | A | 8/1977 | Shimauchi et al. | |
| 4,088,052 | A | 5/1978 | Hedrick | |
| 4,088,916 | A | 5/1978 | Weineck et al. | 310/338 |
| 4,112,879 | A | 9/1978 | Assenheimer et al. | 123/32 EA |
| 4,157,802 | A | 6/1979 | May, Jr. | 248/346 |
| 4,196,652 | A | 4/1980 | Raskin | |
| 4,207,791 | A | 6/1980 | Murakami | |
| 4,208,636 | A | 6/1980 | German | 331/94.5 P |
| 4,228,680 | A | 10/1980 | Engel et al. | 73/119 A |
| 4,313,361 | A | 2/1982 | Deutsch | |
| 4,319,843 | A | 3/1982 | Gornall | 356/346 |
| 4,327,623 | A | 5/1982 | Mochida et al. | |
| 4,336,809 | A | 6/1982 | Clark | 128/665 |
| 4,388,908 | A | 6/1983 | Babitzka et al. | 123/500 |
| 4,426,907 | A | 1/1984 | Scholz | |
| 4,426,981 | A | 1/1984 | Greiner et al. | 123/488 |
| 4,430,899 | A | 2/1984 | Wessel | 73/754 |
| 4,432,228 | A | 2/1984 | Kuschmierz et al. | 73/119 |
| 4,434,753 | A | 3/1984 | Mukainakano et al. | 123/143 |
| 4,463,727 | A | 8/1984 | Babitzka et al. | 123/458 |
| 4,468,583 | A | 8/1984 | Mori | 310/328 |
| 4,479,475 | A | 10/1984 | Babitzka | 123/446 |
| 4,570,096 | A | 2/1986 | Hara et al. | 310/328 |
| 4,580,540 | A | 4/1986 | Babitzka et al. | 123/458 |
| 4,584,923 | A | 4/1986 | Minnick | |
| 4,617,952 | A | 10/1986 | Fujiwara et al. | 137/85 |

(List continued on next page.)

FOREIGN PATENT DOCUMENTS

| | | |
|---|---|---|
| EP | 0 704 916 A1 | 9/1995 |
| JP | 5-305574 | 11/1993 |
| WO | WO 98/23868 | 6/1998 |

OTHER PUBLICATIONS

US 5,877,442, 03/1999, Freland et al. (withdrawn)

*Primary Examiner*—Marlon T. Fletcher
(74) *Attorney, Agent, or Firm*—Young & Basile, P.C.

(57) ABSTRACT

The present invention provides a method for automatically tuning a stringed instrument including the steps of inducing a signal on a string under tension to generate a resonance signal having an amplitude from the string and adjusting tension of the string in response to the amplitude of the resonance signal. The present invention also provides a system for automatically tuning a stringed instrument including a string, tensioning means operably attached to one end of the string for tensioning the string, and a processor for driving the tensioning means to induce a signal on the string and generate a resonance signal having an amplitude from the string and for adjusting tension of the string in response to the amplitude of the resonance signal.

20 Claims, 6 Drawing Sheets

U.S. PATENT DOCUMENTS

| | | | | |
|---|---|---|---|---|
| 4,629,926 | A | 12/1986 | Siegal | 310/331 |
| 4,660,523 | A | 4/1987 | Brauer et al. | 123/458 |
| 4,667,639 | A | 5/1987 | Linder et al. | 123/450 |
| 4,697,118 | A | 9/1987 | Harnden, Jr. et al. | 310/331 |
| 4,714,855 | A | 12/1987 | Fujimoto | 310/328 |
| 4,725,002 | A | 2/1988 | Trachte | 239/102.2 |
| 4,732,071 | A | 3/1988 | Deutsch | |
| 4,735,185 | A | 4/1988 | Imoto et al. | 123/498 |
| 4,736,131 | A | 4/1988 | Fujimoto | 310/328 |
| 4,749,897 | A | 6/1988 | Natsume et al. | 310/317 |
| 4,750,706 | A | 6/1988 | Schlagmüler | 251/129.06 |
| 4,757,223 | A | 7/1988 | Ueyama | 310/82 |
| 4,777,398 | A | 10/1988 | Shibuya | 310/328 |
| 4,793,313 | A | 12/1988 | Paganon et al. | 123/506 |
| 4,803,908 | A | 2/1989 | Skinn et al. | |
| 4,821,726 | A | 4/1989 | Tamura et al. | 123/498 |
| 4,838,233 | A | 6/1989 | Hayashi et al. | 123/506 |
| 4,874,979 | A | 10/1989 | Rapp | 310/328 |
| 4,893,750 | A | 1/1990 | Haworth et al. | 239/71 |
| 4,909,126 | A | 3/1990 | Skinn et al. | |
| 4,940,037 | A | 7/1990 | Eckert | 123/506 |
| 4,947,077 | A | 8/1990 | Murata | 310/328 |
| 5,009,142 | A | 4/1991 | Kurtz | |
| 5,027,027 | A | 6/1991 | Orbach et al. | 310/317 |
| 5,034,647 | A | 7/1991 | Ohtsuka | 310/328 |
| 5,038,657 | A | 8/1991 | Busley | 84/455 |
| 5,040,514 | A | 8/1991 | Kubach | 123/490 |
| 5,065,660 | A | 11/1991 | de Buda | |
| 5,080,079 | A | 1/1992 | Yoshida et al. | 123/531 |
| 5,094,429 | A | 3/1992 | Dostert | 251/129.06 |
| 5,109,885 | A | 5/1992 | Tauscher | 137/554 |
| 5,157,256 | A | 10/1992 | Aaron | 250/306 |
| 5,161,774 | A | 11/1992 | Engelsdorf et al. | 251/11 |
| 5,182,484 | A | 1/1993 | Culp | 310/328 |
| 5,199,641 | A | 4/1993 | Hohm et al. | 239/102.2 |
| 5,237,238 | A | 8/1993 | Berghaus et al. | 310/328 |
| 5,314,175 | A | 5/1994 | Izumi et al. | 269/224 |
| 5,319,257 | A | 6/1994 | McIntyre | 310/328 |
| 5,323,680 | A | 6/1994 | Miller et al. | |
| 5,328,149 | A | 7/1994 | Reuter | 251/129.06 |
| 5,332,942 | A | 7/1994 | Rennex | 310/328 |
| 5,335,862 | A | 8/1994 | Esper | 239/570 |
| 5,343,793 | A | 9/1994 | Pattie | 84/454 |
| 5,390,579 | A | 2/1995 | Burgon | 84/454 |
| 5,410,206 | A | 4/1995 | Luecke et al. | 310/328 |
| 5,413,076 | A | 5/1995 | Koenigswieser et al. | 123/446 |
| 5,425,343 | A | 6/1995 | Akaki et al. | 123/490 |
| 5,435,477 | A | 7/1995 | Torihata et al. | 228/4.5 |
| 5,460,202 | A | 10/1995 | Hanley et al. | 137/627 |
| 5,465,021 | A | 11/1995 | Visscher et al. | 310/328 |
| 5,477,831 | A | 12/1995 | Akaki et al. | 123/490 |
| 5,482,213 | A | 1/1996 | Matsusaka et al. | 239/584 |
| 5,518,184 | A | 5/1996 | Potz et al. | 239/533.4 |
| 5,645,226 | A | 7/1997 | Bright | 239/585.1 |
| 5,685,485 | A | 11/1997 | Mock et al. | 239/102.2 |
| 5,697,554 | A | 12/1997 | Auwaerter et al. | 239/88 |
| 5,712,524 | A | 1/1998 | Suga | 310/328 |
| 5,751,090 | A | 5/1998 | Henderson | 310/328 |
| 5,779,149 | A | 7/1998 | Hayes, Jr. | 239/124 |
| 5,780,759 | A | 7/1998 | Szalay | |
| 5,780,956 | A | 7/1998 | Oliver et al. | 310/323 |
| 5,780,957 | A | 7/1998 | Oliver et al. | 310/328 |
| 5,803,370 | A | 9/1998 | Heinz et al. | 239/533 |
| 5,810,255 | A | 9/1998 | Itoh et al. | 239/102.2 |
| 5,824,929 | A | 10/1998 | Freeland et al. | |
| 5,824,937 | A | 10/1998 | Szalay | |
| 5,831,264 | A | 11/1998 | Shedd et al. | 250/306 |
| 5,847,387 | A | 12/1998 | Shedd et al. | 250/306 |
| 5,859,378 | A | 1/1999 | Freeland et al. | |
| 5,875,764 | A | 3/1999 | Kappel et al. | 123/467 |
| 5,881,767 | A | 3/1999 | Löser | 137/599 |
| 5,883,323 | A | 3/1999 | Kaufman | 84/454 |
| 5,886,270 | A | 3/1999 | Wynn | 84/313 |
| 5,901,896 | A | 5/1999 | Gal | 228/4.5 |
| 5,907,212 | A | 5/1999 | Okada | 310/328 |
| 5,907,269 | A | 5/1999 | Zrostlik | 335/215 |
| 5,934,976 | A | 8/1999 | Makino et al. | 451/28 |
| 5,975,428 | A | 11/1999 | Potschin et al. | 239/88 |
| 5,977,467 | A | 11/1999 | Freeland et al. | 84/454 |
| 6,016,040 | A | 1/2000 | Hoffmann et al. | 318/116 |
| 6,021,760 | A | 2/2000 | Boecking | 123/467 |
| 6,025,671 | A | 2/2000 | Boecking | 310/369 |
| 6,035,722 | A | 3/2000 | Giersch et al. | 73/714 |
| 6,040,643 | A | 3/2000 | Bruns | 310/26 |
| 6,060,814 | A | 5/2000 | Hoffmann et al. | 310/316.03 |
| 6,062,533 | A | 5/2000 | Kappel et al. | 251/57 |
| 6,104,125 | A | 8/2000 | Pan et al. | 310/328 |
| 6,131,879 | A | 10/2000 | Kluge et al. | 251/129.06 |
| 6,166,307 | A | 12/2000 | Caulkins et al. | 84/454 |

METHOD AND SYSTEM FOR AUTOMATICALLY TUNING A STRINGED INSTRUMENT

CROSS-REFERENCE TO RELATED APPLICATIONS

This application claims the benefit of U.S. Provisional Application No. 60/187,597 filed Mar. 7, 2000.

FIELD OF THE INVENTION

This invention relates to a method and system for automatically tuning a stringed instrument.

BACKGROUND OF THE INVENTION

All stringed musical instruments require tuning due to changes in physical conditions or changes in the characteristics of the materials from which the instruments are made. Many stringed instruments, such as guitars, drift out of tune quite rapidly and musicians often need to make tuning adjustments during the course of normal use. Systems for automatically tuning a stringed instrument are known, however, such prior art systems have many shortcomings. Prior art automatic tuning systems are relatively large in size and, thus, can not be retrofitted to some instruments. When assembled to an instrument, the size of prior art systems often detracts from the original aesthetics of the instrument. Further, the installation of prior art systems to an instrument distorts the original tonal qualities of the instrument. Prior art systems also consume large amounts of power and, thus, require large power supplies which must be located remotely from the instrument. Additionally, prior art automatic tuning systems tune the instrument via complex signal frequency means or less accurate string tension means. Accordingly, there is a desire for an improved automatic tuning system for a stringed instrument.

SUMMARY OF THE INVENTION

The present invention provides a method for automatically tuning a stringed instrument including the steps of inducing a signal on a string under tension to generate a resonance signal having an amplitude from the string and adjusting tension of the string in response to the amplitude of the resonance signal. The present invention also provides a system for automatically tuning a stringed instrument including a string, tensioning means operably attached to one end of the string for tensioning the string, and a processor for driving the tensioning means to induce a signal on the string and generate a resonance signal having an amplitude from the string and for adjusting tension of the string in response to the amplitude of the resonance signal.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
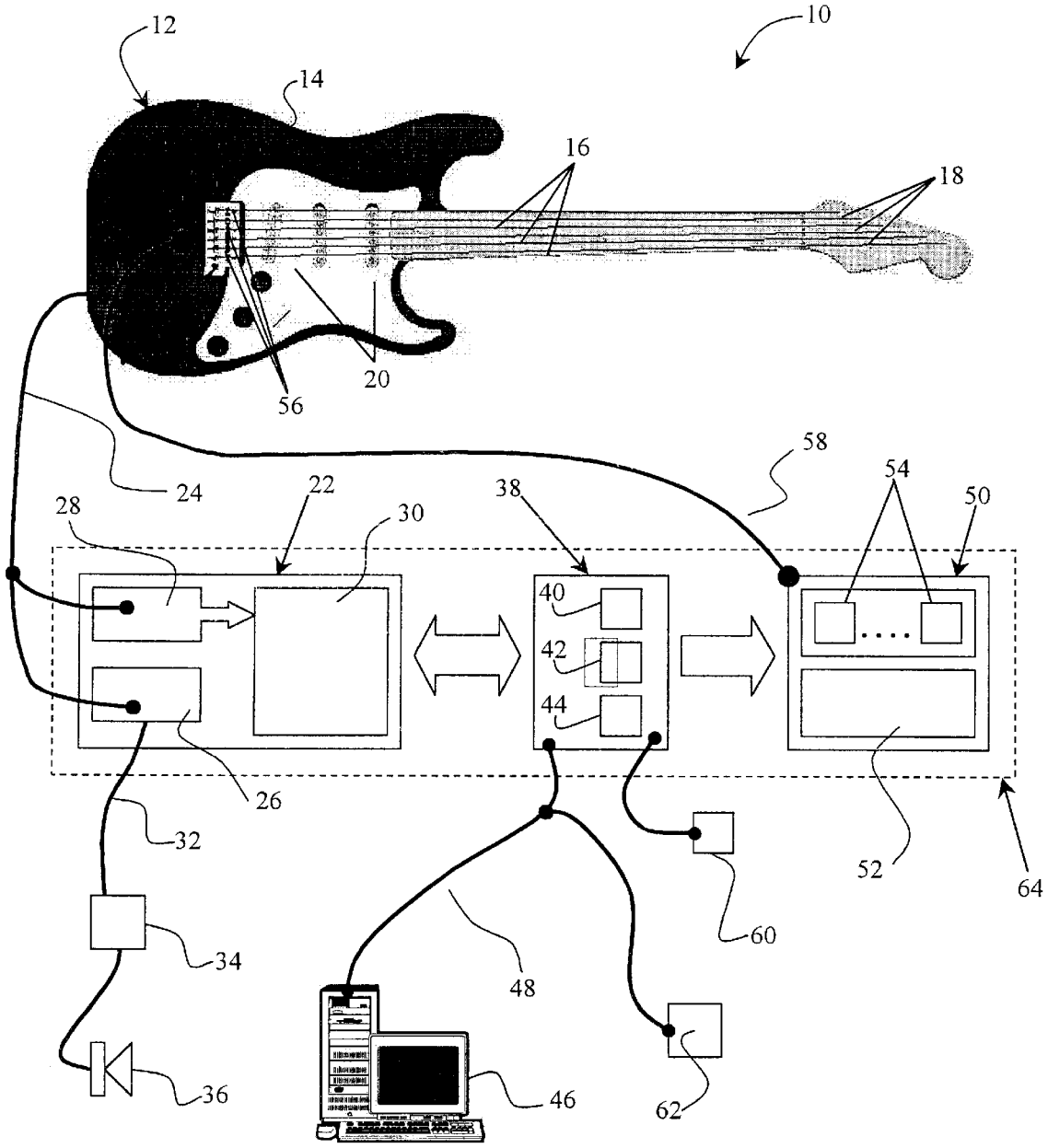
FIG. 1 is a schematic of an automatic tuning system for a stringed instrument in accordance with the present invention.

FIG. 1 is a schematic of an automatic tuning system 10 in accordance with the present invention. The automatic tuning system 10 can be adapted to adjust the tension of a wide variety of structures including, but not limited to, wires, cables, strings, or the like. Further, the automatic tuning system 10 is particularly designed to adjust such structures to a predetermined response.

In one embodiment, the system 10 is adapted for tuning any stringed instrument, such as a bass, piano, or violin, etc. More specifically, this embodiment of the system 10 is designed to automatically and simultaneously tune one or more strings of an instrument. By way of example and not limitation, the components and operation of the automatic tuning system 10 are described in relation to the tuning of an electric guitar 12 having a body 14, one or more strings 16, and a manual tuner 18 for each string 16. Each string 16 and each manual tuner 18 is secured to the body 14 of the guitar 12. To "play" the guitar 12, a user or musician strums or stretches the guitar strings 16 thereby creating string vibrations.

The automatic tuning system 10 includes one or more audio input transducers 20 which produce electrical analog signals in response to the string vibrations. Many types of guitars include one or more audio input transducers which are integral to the guitar. With such guitars, the integrated audio input transducers may be used to provide the analog signals to the automatic tuning system 10. With the remaining guitars, one or more audio input transducers may be retrofitted to the guitar.

The automatic tuning system 10 also includes a signal interface 22. The analog signals produced by the one or more audio input transducers 20 are transmitted through a transducer output channel 24 to the signal interface 22. The signal interface 22 is designed to route and condition the analog signals for processing within the automatic tuning system 10. The signal interface 22 includes a signal muting circuit 26, a signal conditioning circuit 28, and an ADC (analog to digital converter) 30. Each analog signal produced by the one or more audio input transducers 20 is transmitted to both the signal muting circuit 26 and the signal conditioning circuit 28.

During normal play, each analog signal is transmitted from the signal muting circuit 26 through an amplifier output channel 32 to an audio amplifier 34. The audio amplifier 34 amplifies each analog signal received and produces an electrical signal which when input to an appropriate audio transducer 36, such as a speaker, creates audible sounds. In this manner, the string vibrations created when the musician strums or stretches the strings 16 are transformed into amplified music. One of ordinary skill in the art will recognize that the present invention can be practiced without the audio amplification described above.

When the guitar 12 is being automatically tuned by the system 10, the signal muting circuit 26 is designed to prevent the transmission of all analog signals to the amplifier output channel 32 and, in turn, to the audio amplifier 34. In other words, the signal muting circuit 26 mutes the output of the guitar 12 during automatic tuning of the guitar strings 16. This signal muting operation can optionally be disabled.

The signal conditioning circuit 28 includes one or more signal amplifiers and signal filters to condition each analog signal from the one or more audio input transducers 20 for optimal input to the ADC 30. The ADC 30 converts each analog signal into a digital signal. Each digital signal is generated in a predetermined data format, such as a multi-bit linear code or other such structure, suitable for digital signal processing.

The automatic tuning system 10 further includes a processor 38 having a central processing unit (CPU) 40, memory 42, and digital signal processing capabilities 44. The types of digital signal processing which may be used in the present invention include, but are not limited to, lowpass filters, bandpass filters, highpass filters, demultiplexing and fast fourier transforms. The processor 38 is also capable of standard two-way communications. Two-way communications between the processor 38 and a remotely located computer 46 are transmitted through an external interface 48 as described in greater detail below.

In one embodiment, a signal conditioning circuit 28, an ADC 30, and a processor 38 are dedicated to each string 16 of the guitar 12 to be tuned. One of ordinary skill in the art will recognize that there are a variety of alternative embodiments employing signal multiplexing or other means to eliminate the need for a separate signal conditioning circuit 28 and/or ADC 30 and/or processor 38 for each string 16. These embodiments allow a trade-off between tuning speed and accuracy versus electronic complexity, size, and cost.

The automatic tuning system 10 also includes an actuator driver 50 controlled by the processor 38. The actuator driver 50 includes a power supply 52, one or more driver circuits 54, and a motor 56 for each driver circuit 54. Each driver circuit 54 is coupled with a separate motor 56 via an actuator output channel 58. Each guitar string 16 is also connected to a separate motor 56. Each driver circuit 54 is controlled by the processor 38 to operate or move the respective motor 56. The operation of each motor 56 either tautens (tightens) or slackens (loosens) the respective guitar string 16. In other words, each driver circuit 54 is controlled by the processor 38 to operate the respective motor 56 to increase or decrease the tension of a particular guitar string 16.

The operation or response of a motor 56 is controlled by the type of input voltage drive profile supplied to the motor 56 by the driver circuit 54. In other words, the drive profile of the input voltage signal supplied to a motor 56 by a driver circuit 54 controls the operation or response of the motor 56. There are various types of driver circuits and, thus, drive profiles commercially available. Accordingly, one of ordinary skill in the art may select from several input voltage drive profiles each of which produces a different motor response.

The automatic tuning system 10 further includes a plurality of user interfaces, preferably a manual switch interface 60 and an external interface 48. The manual switch interface 60 provides a user with a manual input means at the body 14 of the guitar 12. The manual switch interface 60 is composed of tuning selector means, tuning actuation means, tuning learning means, communications means to a remote computer 46, and mute disable means. Upon activation of the tuning actuation means, the processor 38 retrieves codes from the processor memory 42 which represent a previously stored string tuning pattern. The processor 38 then uses these codes to automatically produce said tuning pattern across the strings 16 on the guitar 12. The processor 38 uses the setting in the tuning selector means to determine which of a plurality of pre-stored tuning pattern codes to use for the tuning process. In like fashion, activation of the learning means causes the processor 38 to store tuning pattern codes in the processor memory 42. Upon activation of the learning means, the processor 38 stores the tuning pattern codes into the processor memory location indicated by the tuning selector means. Upon activation of the mute disable means, muting of the signal to the audio amplifier 34 is disabled and the signal generated by the strings 16 can be heard through the audio transducer 36.

One embodiment of the manual switch interface 60 in includes a multi-position rotary selector switch and three or more push-button switches. An alternative embodiment uses an electronic display with touch screen capability. These embodiments of the manual switch interface 60 are illustrative only. Various alternatives and modifications are well known to those of ordinary skill in the art.

The external interface 48 is preferably the type of interface typically associated with a personal computer. Preferably, the external interface 48 is a MIDI (Music Instrument Data Interface) type interface as commonly known and accepted in the music industry. Alternatively, the external interface 48 can be a standard RS232 type interface. One function of the external interface 48 is to couple the processor 38 to a floor switch box 62 thus providing second manual switching means, similar to the manual switch interface 60, for selecting preset string tension patterns. Another function of the external interface 48 is to couple the processor 38 to a computer 46 for the purpose of programming one or more string tension patterns into the system 10 and for providing third manual switching means, similar to the manual switch interface 60, for selecting preset string tension patterns. Preferably, the processor 38 is programmable and, as such, one of ordinary skill in the art could program the functionality of the interfaces 60 and 48 in a plurality of ways. One of ordinary skill in the art will recognize that the present invention can be practiced without the computer 46 and/or the floor switch 62.

The automatic tuning system 10 is designed to be installed or assembled as an original component of the guitar 12. Alternatively, the system 10 can be retrofitted to an existing guitar. As either an original or retrofit component, the system 10 has been adapted to preserve the original tonal qualities of the guitar 12.

The signal interface 22, the processor 38, and the actuator driver 50 are contained in a case 64 packaged to the body 14 of the guitar 12. The motors 56 are located or packaged adjacent to the ends of the guitar strings 16 opposite the manual tuners 18. As such, the automatic tuning system 10 does not effect or alter the typical mechanics associated with playing the guitar 12.

Figure 2:
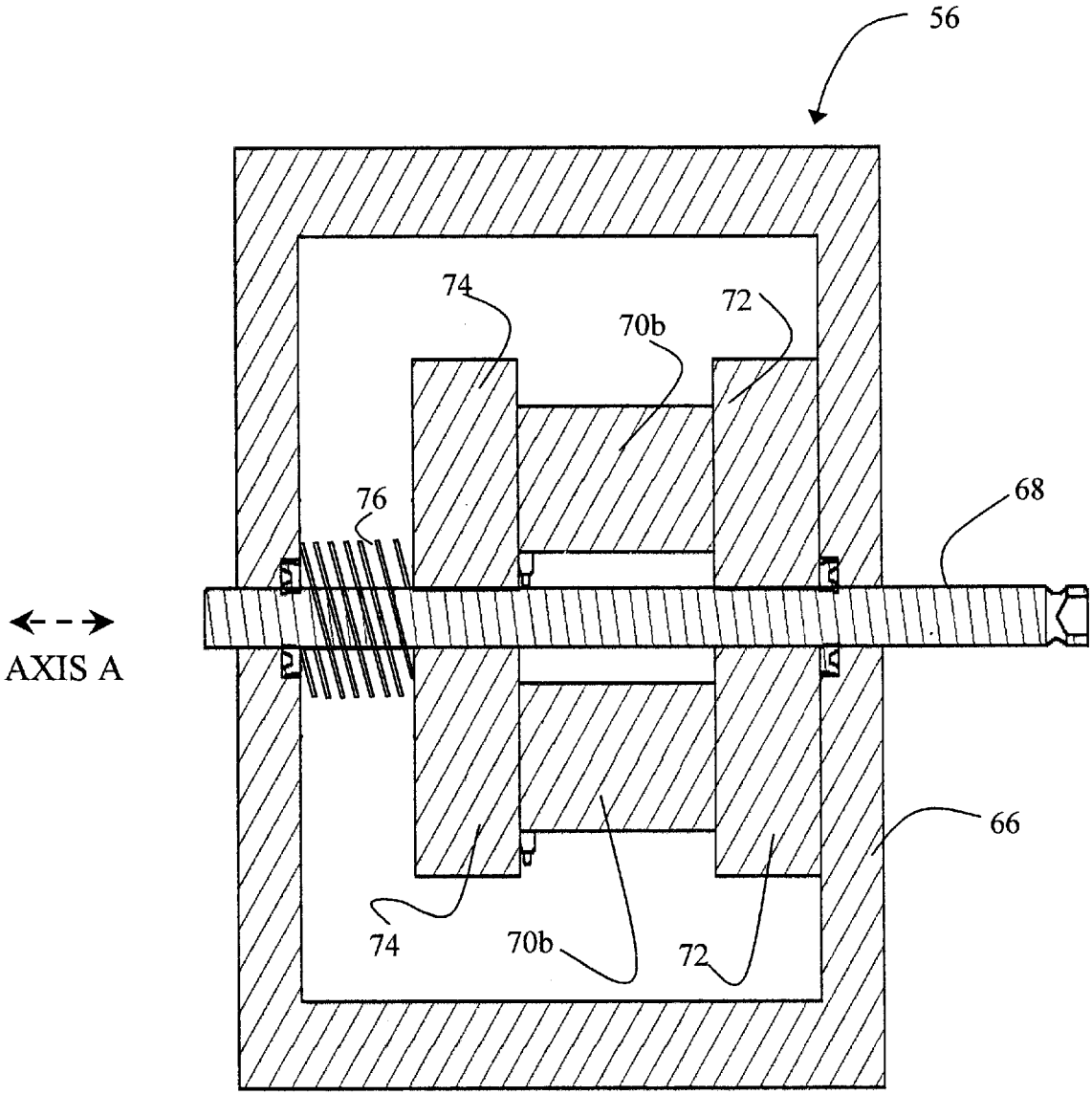
FIG. 2 is a schematic, cross-sectional view of one embodiment of a linear motor for use in the present invention.
Figure 3:
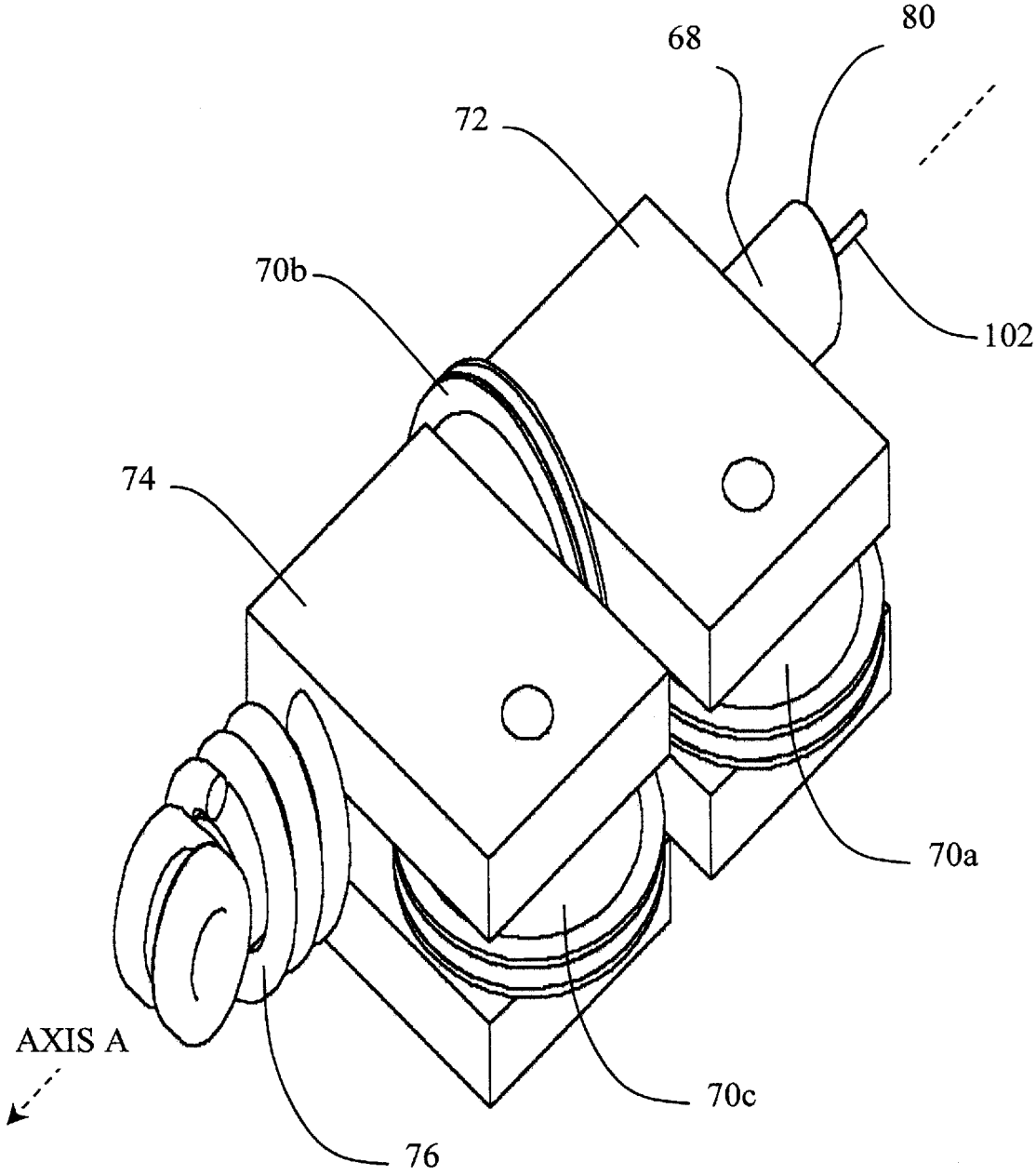
FIG. 3 is a perspective view of internal components of the linear motor in FIG. 2.

FIG. 2 is a schematic, cross-sectional view of a linear motor 56 for use in the present invention, showing the internal components of the linear motor 56. The linear motor 56 is shown in schematic illustration for descriptive purposes. The linear motor 56 is encased in a housing 66. The housing 66 is designed to protect the linear motor 56. The linear motor 56 is assembled to the body 14 of the guitar 12. In this embodiment, the linear motor 56 so attached is capable of moving a rod 68, having any cross-sectional shape, in either direction along axis A in FIG. 2. In other words, the fixed linear motor 56 is capable of moving the rod 68 left or right relative to the linear motor 56 as illustrated in FIG. 2. To accomplish this movement, the linear motor 56 operates in a walking beam feeder fashion, shown in FIG. 4 and described in greater detail below. To perform the walking beam feeder movement, the linear motor 56 includes three piezo or piezoelectric actuators 70*a,* 70*b,* and 70*c* (piezo actuator 70*a* and 70*c* are shown in FIG. 3), a pair of clamps 72 and 74, and a resilient means 76. The first clamp 72 is fixed to the housing 66 and the second clamp 74 is free from the housing 66. In alternative embodiments of the present invention, the resilient means 76 may comprise an actuator retractor spring (as shown in FIG. 2), an o-ring or other similar type of resilient structure, or another piezo actuator. The resilient means 76 is disposed between the second clamp 74 and the housing 66. The linear motor 56 further includes an electrical connector (not shown in FIG. 2) for receiving power to operate of the linear motor 56.

FIG. 3 is a perspective view of selected internal components of the linear motor 56 used to accomplish the walking beam feeder movement. The two clamps 72 and 74 are adapted to clamp or hold the rod 68. The axis of the rod 68 is aligned perpendicular to the two clamps 72 and 74. The rod 68 is disposed within the jaws of the two clamps 72 and 74. In the present embodiment, a musical string 16 is secured to the end 80 of the rod 68 adjacent to the first clamp 72. In alternative embodiments, a flexible structure, such as a cable, wire or the like can be secured to the end 80 of the rod 68 adjacent to the first clamp 72.

The two outermost actuators 70*a* and 70*c* are operated between an energized state, wherein voltage is applied to the actuator, and a de-energized state, wherein no voltage is applied to the actuator. The two outermost actuators 70*a* and 70*c* are normally de-energized. When the first actuator 70*a* is de-energized, the first clamp 72 is closed, or clamps to or engages the rod 68. When the third actuator 70*c* is de-energized, the second clamp 74 is closed, or clamps to or engages the rod 68.

Each of the three actuators 70*a–c* is energized by applying a voltage to the respective actuator. Energizing the first actuator 70*a* disengages the first clamp 72 from the rod 68. Energizing the third actuator 70*c* disengages the second clamp 74 from the rod 68. In other words, energizing the first actuator 70*a* opens the first clamp 72 thereby releasing the rod 68 and energizing the third actuator 70*c* opens the second clamp 74 thereby releasing the rod 68.

The second or central actuator 70*b* is disposed between the first and second clamps 72 and 74 providing a nominal displacement between the first and second clamps 72 and 74. When energized, the second actuator 70*b* provides an increase in the displacement between the two clamps 72 and 74. In other words, when energized, the second actuator 70*b* provides an expansion force which pushes the two clamps 72 and 74 apart or away from each other. Within the normal or typical operating voltage range, the amount of increase in the displacement between the two clamps 72 and 74 is proportional to the amount of voltage applied across the second actuator 70*b*.

When de-energized, the second actuator 70*b* provides a decrease in the displacement between the two clamps 72 and 74. Piezo actuators, especially piezo stacks, provide a contraction force significantly lower or weaker than the aforementioned expansion force and are susceptible to failure caused by tension during contraction. Accordingly, the resilient means 76 is adapted to bias or push the second clamp 74 toward the second actuator 70*b*. In alternative embodiments, the resilient means 76 can provide all or part of the force necessary to move the two clamps 72 and 74 back to the nominal displacement.

The operation of the three actuators 70*a–c* may be sequenced to move the rod 68 in one direction or the opposite direction along axis A of the rod 68. FIGS. 4A–4G are a series of schematics illustrating an operation of the linear motor 56 for moving the rod 68 in one direction. In other words, FIGS. 4A–4G illustrate a sequence of operations performed by the linear motor 56 to move the rod 68 in a direction of travel as indicated by arrow 82.

Figures 4A, 4B, 4C, 4D, 4E, 4F, 4G:
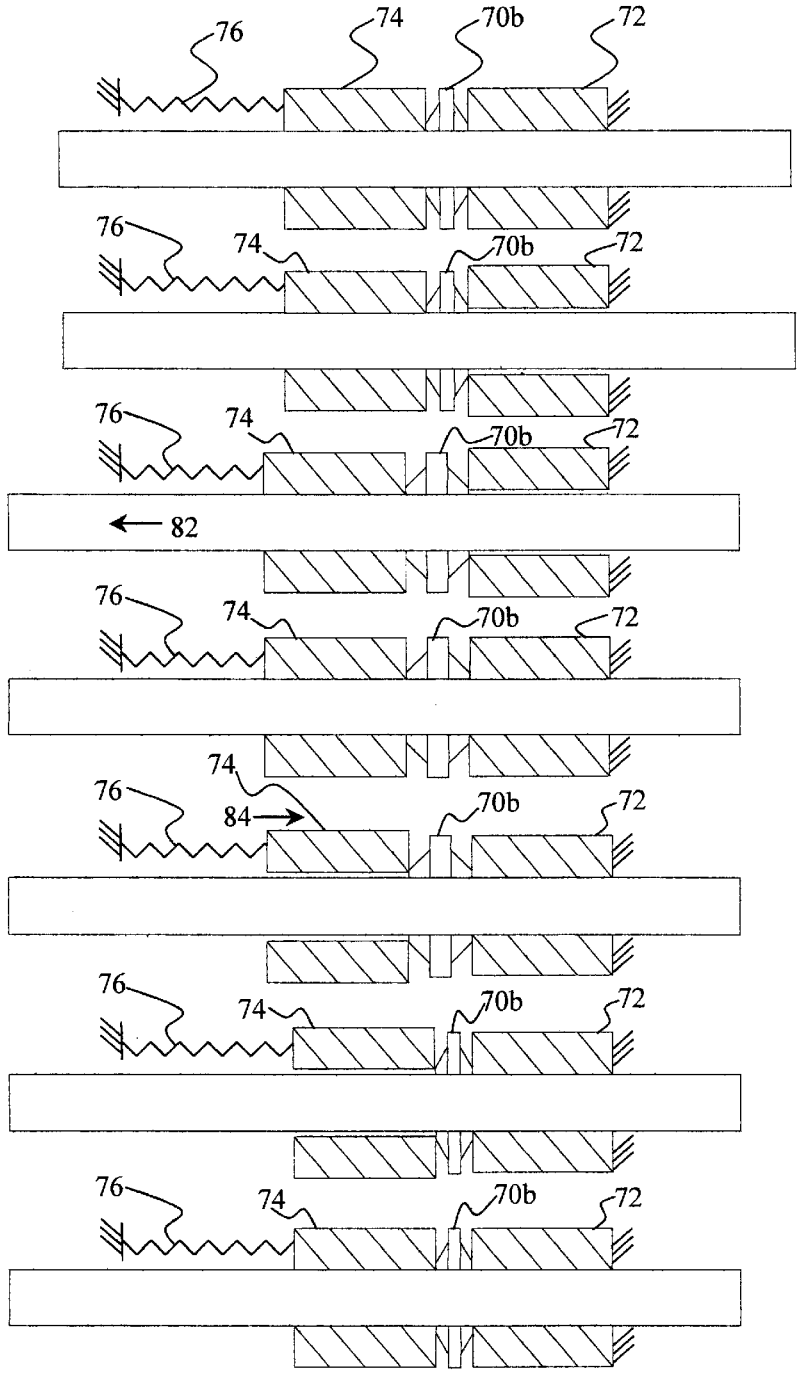
FIGS. 4A–4G are a series of schematics illustrating an operation of the linear motor of FIGS. 2 and 3 for moving a rod in one direction.

FIG. 4A illustrates the linear motor 56 in a first position. The second actuator 70*b* is de-energized and the first and second clamps 72 and 74 are clamped to the rod 68. The first clamp 72 is fixed to the housing 66 or anchored in a fixed location or to a fixed surface. During the first operation, voltage to each of the three actuators 70*a–c* is switched off and the displacement between the first and second clamps 72 and 74 is nominal.

FIG. 4B illustrates the linear motor 56 in a second position. The first clamp 72 is opened by energizing the first actuator 70*a*. During the second operation, the rod 68 is released by the first clamp 72.

FIG. 4C illustrates the linear motor 56 in a third position. A voltage is applied to the second actuator 70*b* thus energizing the second actuator 70*b* and providing an increase in the displacement between the first and second clamps 72 and 74. During the third operation, the expansion of the second actuator 70*b* forces the second clamp 74 and the rod 68 in a direction of travel as indicated by arrow 82.

Movement of the second clamp 74 compresses the resilient means 76 against the housing 66.

FIG. 4D illustrates the linear motor 56 in a fourth position. The first clamp 72 is closed by de-energizing the first actuator 70*a*. During the fourth operation, the first clamp 72 clamps to the rod 68.

FIG. 4E illustrates the linear motor 56 in a fifth position. The second clamp 74 is opened by energizing the third actuator 70*c*. During the fifth operation, the rod 68 is released by the second clamp 74.

FIG. 4F illustrates the linear motor 56 in a sixth position. The second actuator 70*b* is de-energized. During the sixth operation, the resilient means 76 pushes the second clamp 74 in the direction of travel indicated by arrow 84.

FIG. 4G illustrates the linear motor 56 in a seventh position. The second actuator 70*b* is de-energized and the first and second clamps 72 and 74 are clamped to the rod 68. During the seventh operation, voltage to each of the three actuators 70*a–c* is switched off and the displacement between the first and second clamps 72 and 74 is nominal. The seventh position is similar to the first position but with the rod 68 moved in the direction of travel as indicated by arrow 82 relative to the linear motor 56.

The linear motor 56 is capable of performing the seven step operational sequence in less than or equal to approximately 400 to 4,000 microseconds. A single cycle of the seven step operational sequence will nominally move or displace the rod 68 approximately 12 micrometers. To move or displace the rod 68 a distance greater than the nominal displacement produced by the second actuator 70*b,* the seven step operational sequence may be repeated or cycled two or more times. To move or displace the rod 68 a distance less than the nominal displacement produced by the second actuator 70*b,*the amount of voltage applied to the second actuator 70*b* is reduced proportionally. For example, to move or displace the rod 68 a distance of one-half the nominal displacement produced by the second actuator 70*b,* one-half the nominal voltage is applied to the second actuator 70*b*. To move or displace the rod 80 a distance of one-quarter the nominal displacement produced by the second actuator 70*b,* one-quarter the nominal voltage is applied to the second actuator 70*b*.

The sequence of operations performed by the linear motor 56 may be modified to move the rod 68 in the direction opposite of arrow 82. Further, the present invention may be practiced by combining one or more operations into a single step. By moving the rod 68 in opposing directions, the linear motor 56 is capable of tightening or loosening the respective guitar string 16. In other words, the linear motor 56 can increase or decrease the tension of the guitar string 16. One of ordinary skill in the art will recognize that other types of linear motors or like structures which are capable of providing tension on a string 16 may also be used within the present invention.

Figure 5:
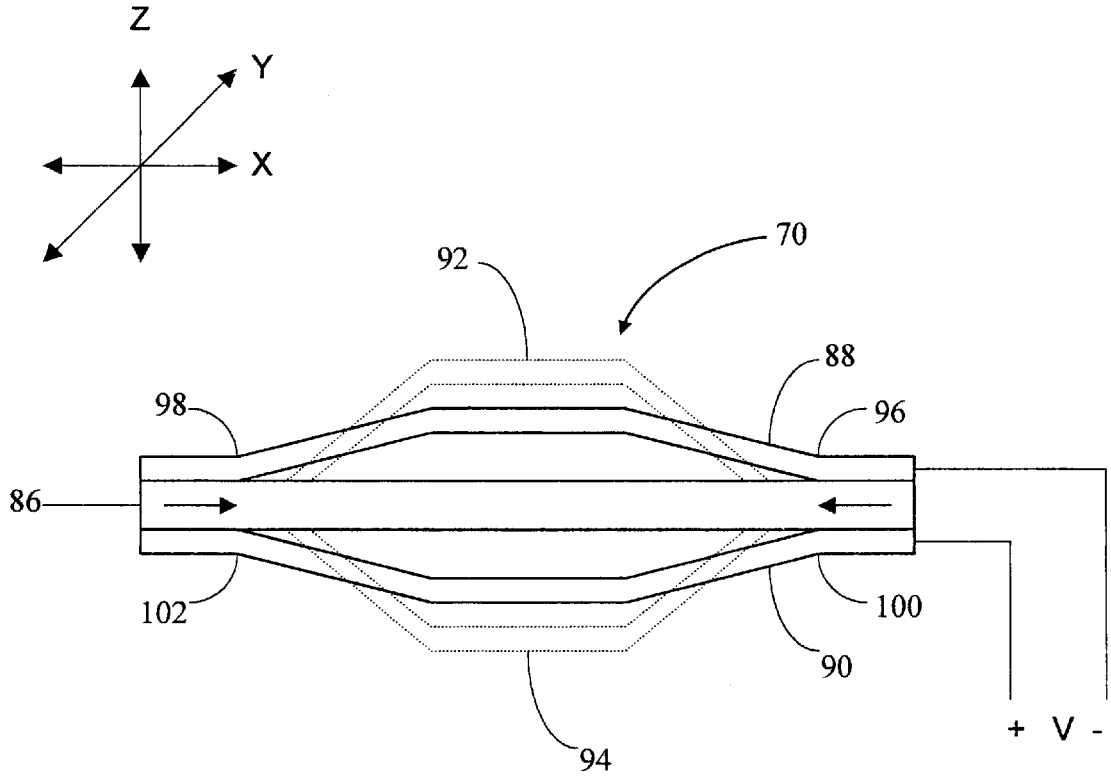
FIG. 5 is a cross-sectional view of one embodiment of an actuator for use in the linear motor.

FIG. 5 is a cross-sectional view of one embodiment of an actuator 70 for use in the linear motor 56 of the present invention. The actuator 70 is designed to produce a positional or spatial displacement along one predetermined axis when energized. In other words, the cross-section of the actuator 70 is designed to expand along at least one predetermined axis when energized. In one embodiment of the present invention, the actuator 70 includes a ceramic substrate 86 sandwiched between two opposing end caps 88 and 90. The two end caps 88 and 90 are preferably formed in the shape of truncated cones. In one embodiment of the present invention, the two end caps 88 and 90 are made from sheet metal. Each end cap 88 and 90 includes a contact surface 92 and 94 respectively. In one embodiment of the present invention, the entire periphery of each end cap 88 and 90 is bonded to the ceramic substrate 86. This type of actuator 70 is commonly referred to in the art as a cymbal actuator.

The actuator 70 is operated between a de-energized state, illustrated in FIG. 5 with solid lines, providing a spatial displacement equal to the nominal thickness of the ceramic substrate 86 and the end caps 88 and 90, and an energized state, illustrated in FIG. 5 with dashed lines, providing a spatial displacement greater than the nominal thickness of the actuator 70. The actuator 70 is normally de-energized.

The actuator 70 is energized by applying a voltage or potential V across the ceramic substrate 86. The voltage causes the substrate 86 to expand along the Z axis and contract along the X and Y axes as designated in FIG. 5. As a result, both end caps 88 and 90 flex or bow outwardly from the substrate 86 about flex points 96, 98 and 100, 102, respectively. Thus, the contraction of the ceramic substrate 86 shortens the distance between the sidewalls of each end cap 88 and 90 and increases the distance between the contact surfaces 92 and 94. In this manner, a substantial increase in the displacement between the contact surfaces 92 and 94 is produced.

Within the normal or typical operating voltage range, the increase in the displacement between the contact surfaces 92 and 94 for a given cymbal geometry is proportional to the amount of voltage applied across the ceramic substrate 86. In other words, a nominal voltage produces a nominal displacement, one-half the nominal voltage produces one-half the nominal displacement, one-quarter the nominal voltage produces one-quarter the nominal displacement, etc.

The large, flat contact surfaces 92 and 94 of each end cap 88 and 90 render it practical to stack several actuators 70 in order to achieve greater displacements.

The present invention may also be practiced with other similar types of actuators including, but not limited to, a single or individual piezoelectric element, a stack of individual piezo elements, a mechanically amplified piezo element or stack, or a multilayer cofired piezo stack.

The linear motor 56 has numerous advantages, attributes, and desirable characteristics including, but not limited to, the characteristics listed hereafter. The present invention incorporates relatively simple, inexpensive, low power, reliable controls. More specifically, the linear motor 56 can be powered by a battery. The linear motor 56 is compact in size (i.e. equal to approximately 1 $in^3$) yet physically scalable to dimensions as least as much as a factor of ten greater and highly powerful (i.e. capable of exerting a drive thrust of 35 lbs.). The present invention is highly precise (i.e. capable of producing movement increments of approximately 0.0005 inch), highly efficient (i.e. having an average power consumption of less than 10 Watts when operating and negligible power consumption when idle), and highly reliable (i.e. having a component life expectancy of approximately 250,000,000 cycles). Further, the linear motor 56 produces minimal heat during operation, generates minimal EMI (Electromagnetic Interference) and RFI (Radio-Frequency Interference), and is relatively unaffected by stray EMI and RFI in the area.

Additionally, the present invention is capable of producing an accumulated linear travel distance in excess of 2 kilometers.

Figure 6A:
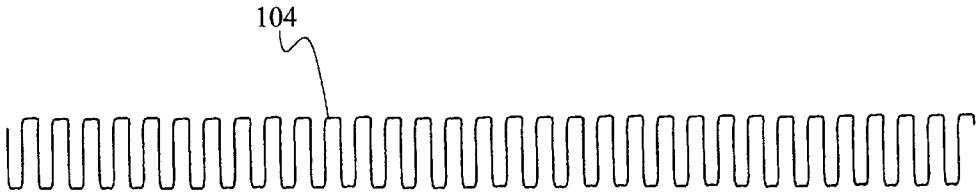
FIGS. 6A–6D illustrate a signal modulation technique used to drive the actuators in the linear motor.
Figure 6B:
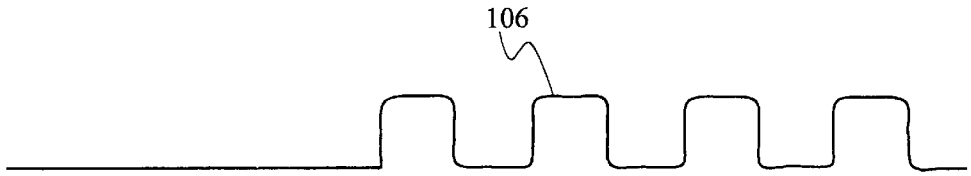
Figure 6C:
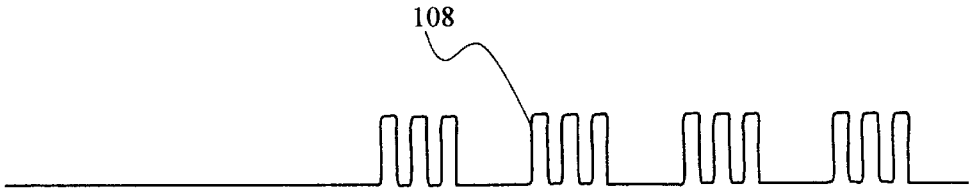
Figure 6D:
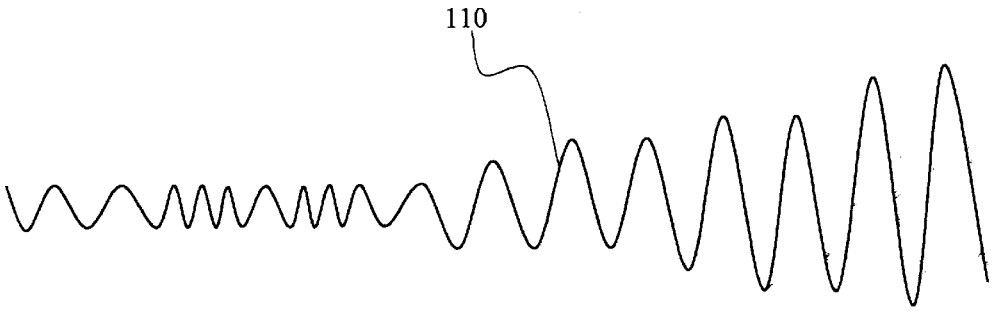

FIG. 6A illustrates an example of a base signal 104 having a frequency. FIG. 6B illustrates an example of a modulation signal 106. FIG. 6C illustrates an example of a modulated motor movement signal 108 created when the base signal 104 is modulated by the modulation signal 106. More specifically, the modulated motor movement signal 108 is produced by the processor 38 performing a logical AND function upon the base signal 104 and the modulation signal 106. The resulting modulated motor movement signal 108 is output from the processor 38 to the drive circuits 54 and then to the motors 56 through the actuator output channel 58. As a result, the modulated motor movement signal 108 causes the motors 56 to alter the tension of the strings 16 on the guitar 12. The adjustment or alteration of string tension occurs essentially simultaneously for all strings 16 on the guitar 12 due to the speed of the system 10. Because the motion of the motors 56 is modulated according to the modulated motor movement signal 108, a signal is induced on the strings 16 as the strings 16 are adjusted. This induced signal is equivalent to the note to be tuned and its harmonics. As the processor 38 is generating the modulated motor movement signal 108, the processor 38 is also monitoring a resonance signal 110 generated from the strings 16. FIG. 6D illustrates an example of a resonance signal 110 generated from a string 16 in response to a signal induced on the string 16 by operation of a motor 56 driven by a modulated motor movement signal 108. As the strings 16 achieve the selected tuning, the signal induced on the strings 16 by the operation of the motors 56 causes the strings 16 to resonate at a higher amplitude. The processor 38 monitors the varying amplitude of the string resonance and adjusts the modulated motor movement signal 108 to attempt to maximize the amplitude of the string resonance. Practically, the processor 38 may have to overshoot the maximum resonance amplitude to achieve the desired tuning. When the processor 38 detects optimal amplitude from each string 16, the processor 38 discontinues generating modulated motor movement signals 108 and the tuning process for the guitar 12 is complete.

Activation of the tuning process and selection of the specific tuning to be achieved are initiated and determined by operation of the manual switch interface 60, the foot box 62, or the remote computer 46 described above.

The codes for base signals 104 are stored in the processor memory 42. The base signals 104 are selected to optimize the results of the modulation and tuning process.

The modulation signal 106 for each tuning is developed during the tuning learning process. The tuning learning process is initiated by activation of the tuning learning means described above. The modulation signal codes are stored in processor memory locations determined by the setting of the tuning selector means described above. The first step in the tuning learning process is for the user or musician to manually tune the guitar 12 for the desired sound. Upon completion of the manual tuning, the musician positions the tuning selector means and activates the tuning learning means. Next, the musician strums the strings 16 on the guitar 12. This action provides a musical signal to the processor 38. The processor 38 uses the musical signal from each string 16 to develop a modulation signal 106. The processor 38 then stores the codes for the modulation signal 106 in the processor memory 42. These stored codes for the modulation signal 106 can be used during a subsequent tuning process by the processor 38 to adjust the tuning of the guitar 12 as described above.

In an alternative embodiment, the tunings can be developed and/or stored in a remote computer 46. The remote computer 46 can be connected to the guitar 12. The processor 38 may select codes for modulation signals 106 of tunings stored in the remote computer 46. Upon such selection and electronic transfer of the appropriate codes from the remote computer 46 to the processor 38, actual tuning of the guitar 12 would occur as described above. In like fashion, codes for a tuning could be electronically transferred from the processor 38 to the remote computer 46.

In yet another embodiment, selection and activation of the tuning process is accomplished via the foot switch box 62 as described above. The foot switch box 62 operates in a fashion similar to the manual switch interface 60. Use of the foot switch box 62 would allow a musician to cause the guitar 12 to obtain an alternative tuning while leaving the musician's hands free for other activities.

What is claimed is:

1. A method for automatically tuning a stringed instrument comprising the steps of:

inducing a signal on a string under tension to generate a resonance signal having an amplitude from the string with tensioning means operable attached to one end of the string; and adjusting tension of the string in response to the amplitude of the resonance signal.

2. The method of claim 1 wherein the induced signal is a musical tone to which the string is to be tuned.

3. The method of claim 1 further including the step of monitoring the amplitude of the resonance signal.

4. The method of claim 1 further including the step of producing a modulated motor movement signal in response to a musical tone and storing the modulated motor movement signal in memory.

5. The method of claim 1 further including the step of producing a modulated motor movement signal from a base signal modulated with a modulation signal.

6. The method of claim 5 wherein one end of the string is operably attached to a motor and the step of inducing a signal on the string includes driving the motor with the modulated motor movement signal.

7. The method of claim 1 wherein the step of adjusting tension of the string includes adjusting tension on the string to produce a maximum amplitude of the resonance signal.

8. The method of claim 1 wherein the stringed instrument includes a plurality of strings and the steps of inducing a signal and adjusting tension are performed in a sequential order on the plurality of strings.

9. A system for automatically tuning a stringed instrument comprising:

a string;

tensioning means operably attached to one end of the string for tensioning the string; and a processor for driving the tensioning means to induce a signal on the string and generate a resonance signal having an amplitude from the string and for adjusting tension of the string in response to the amplitude of the resonance signal.

10. The system of claim 9 wherein the tensioning means comprises a linear motor.

11. The system of claim 9 further including:

an audio input transducer for producing an electrical analog signal in response to the audio resonance signal;

a signal conditioning circuit for conditioning the electrical analog signal; and an analog to digital converter for converting the electrical analog signal to an electrical digital signal and transmitting the electrical digital signal to the processor.

12. The system of claim 9 wherein the processor produces a modulated motor movement signal and further including an actuator driver for receiving the modulated motor movement signal and driving the motor in response to the modulated motor movement signal.

13. The system of claim 9 further including a manual switch interface for initiating automatic tuning of the stringed instrument.

14. The system of claim 9 further including memory and a manual switch interface for storing modulation signals in the memory.

15. The system of claim 14 wherein the manual switch interface selects modulation signals stored in the memory.

16. The system of claim 9 wherein the processor adjusts tension of the string to produce a maximum amplitude of the resonance signal.

17. A method for automatically tuning a stringed instrument, comprising the steps of:

driving a motor operably attached to one end of a string of the stringed instrument;

generating a resonance signal from the string in response to the step of driving the motor, the resonance signal having an amplitude; and adjusting tension of the string in response to the amplitude of the resonance signal.

18. The method of claim 17 wherein the step of adjusting tension of the string comprises the step of adjusting tension on the string to produce a maximum amplitude of the resonance signal.

19. The method of claim 17 wherein the step of driving the motor comprises the steps of:

modulating a base signal with a modulation signal to produce a modulated motor movement signal; and driving the motor with the modulated motor movement signal.

20. The method of claim 17 wherein the step of driving the motor comprises the step of inducing an induced signal on the string, the induced signal a musical tone to which the string is to be tuned.

* * * * *